US006552482B2

(12) United States Patent
Ito et al.

(10) Patent No.: US 6,552,482 B2
(45) Date of Patent: Apr. 22, 2003

(54) COLOR CATHODE RAY TUBE HAVING COLOR SORTING MASK INCLUDING CUT PORTIONS

(75) Inventors: Yoshiaki Ito, Fukaya (JP); Shinichiro Nakagawa, Fukaya (JP); Takashi Murai, Fukaya (JP); Masatsugu Inoue, Kumagaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 92 days.

(21) Appl. No.: 09/916,587

(22) Filed: Jul. 30, 2001

(65) Prior Publication Data

US 2002/0011772 A1 Jan. 31, 2002

(30) Foreign Application Priority Data

Jul. 31, 2000 (JP) ..... 2000-230795

(51) Int. Cl.[7] ..... H01J 29/82; H01J 29/81
(52) U.S. Cl. ..... 313/407; 313/402
(58) Field of Search ..... 313/402, 403–407, 313/408; 445/47

(56) References Cited

U.S. PATENT DOCUMENTS

| | | | | |
|---|---|---|---|---|
| 5,359,259 A | | 10/1994 | Reidinger et al. | |
| 5,686,784 A | * | 11/1997 | Thoms et al. | 313/402 |
| 6,111,346 A | * | 8/2000 | Ito et al. | 313/402 |
| 6,255,765 B1 | * | 7/2001 | Ito et al. | 313/402 |
| 6,274,974 B1 | * | 8/2001 | Ito et al. | 313/402 |
| 6,384,522 B1 | * | 5/2002 | Tani et al. | 313/402 |

* cited by examiner

*Primary Examiner*—Nimeshkumar D. Patel
*Assistant Examiner*—Karabi Guharay
(74) *Attorney, Agent, or Firm*—Oblon, Spivak, McClelland, Maier & Neustadt, P.C.

(57) ABSTRACT

A skirt portion of a mask body includes cut portions. The width of the cut portions along the minor or major axis ranges from 0.10×L to 0.45×L, where L is the distance from an end of the minor or major axis to a diagonal end, and the height of the cut portions along the tube axis is equal to 5% to 40% of the height of the skirt portion along the tube axis in a region near the minor or major axis.

10 Claims, 3 Drawing Sheets

COLOR CATHODE RAY TUBE HAVING COLOR SORTING MASK INCLUDING CUT PORTIONS

CROSS-REFERENCE TO RELATED APPLICATIONS

This application is based upon and claims the benefit of priority from the prior Japanese Patent Application No. 2000-230795, filed July 31, 2000, the entire contents of which are incorporated herein by reference.

BACKGROUND OF THE INVENTION

1. Field of the Invention

The present invention relates to a color cathode ray tube of a shadow-mask type.

2. Description of the Related Art

In a color cathode ray tube that is presently in wide use, a mask body of a shadow mask undergoes thermal expansion as electron beams run against it. This thermal expansion (doming) of the mask body causes color drift. In order to reduce the thermal expansion, the mask body is formed of a material with a coefficient of thermal expansion lower than that of the material of the mask frame, in many cases.

The mask body and the mask frame are fixed to each other by two different welding methods. One is based on a system (MOFA: mask outside frame assembly) in which a skirt portion of the mask body is welded to the outer wall of the mask frame. The other is based on a system (MIFA: mask inside frame assembly) in which the skirt portion of the mask body is welded to the inner wall of the mask frame. The MIFA system currently prevails, since it can lessen partial doming during irradiation with electron beams and easily restrain howling that is caused by vibration from a speaker when it is incorporated in a TV set. The mask body is provided with tongue portions that are fixed to the mask frame. The tongue portions are formed by cutting slit-shaped notches in those regions of the skirt portion of the mask body which are located close to fixing portions to be fixed to the mask frame, thereby isolating the fixing portions from the continuous skirt portion. These tongue portions serve partially to prevent deformation of the mask body.

In general, on the other hand, the skirt portion of the mask body is formed by press forming or the like. The press forming involves a so-called spring back phenomenon such that an open end of the skirt portion spreads out. This spring-back phenomenon frequently occurs when the mask body is formed by press-forming a low-expansion material such as invar. If the skirt portion is slit to form welding tongue portions, the spread of the open end is wide in other portions than the welding tongue portions. In some cases, therefore, the other portions may bulge outwards from the welding tongue portions.

In welding the mask body to the mask frame in this state, excessive stress may act on the welding tongue portions, thereby deforming the tongue portions or shifting the welding positions.

BRIEF SUMMARY OF THE INVENTION

The present invention has been contrived in consideration of these circumstances, and its object is to provide a color cathode ray tube in which a mask body and a mask frame can be prevented from being deformed or dislocated as they are fixed to each other.

According to an aspect of the present invention, there is provided a color cathode ray tube comprising: an envelope including a rectangular panel having a major axis and a minor axis perpendicular to each other; a phosphor screen located on the inner surface of the panel; an electron gun assembly which emits electron beams toward the phosphor screen; and a color sorting mechanism opposed to the phosphor screen, the color sorting mechanism including a mask body, having a rectangular effective portion with a large number of electron beam holes and a skirt portion bent from the periphery of the effective portion and extending along a tube axis perpendicular to the major and minor axes, and a mask frame having an inner wall fixedly fitted with the skirt portion of the mask body, the skirt portion including cut portions, the width of the cut portions along the minor or major axis ranging from 0.10×L to 0.45×L, where L is the distance from an end of the minor or major axis to a diagonal end, and the height of the cut portions along the tube axis being equal to 5% to 40% of the height of the skirt portion along the tube axis in a region near the minor or major axis.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION

A color cathode ray tube according to an embodiment of the present invention will now be described with reference to the accompanying drawings.

Figure 1:
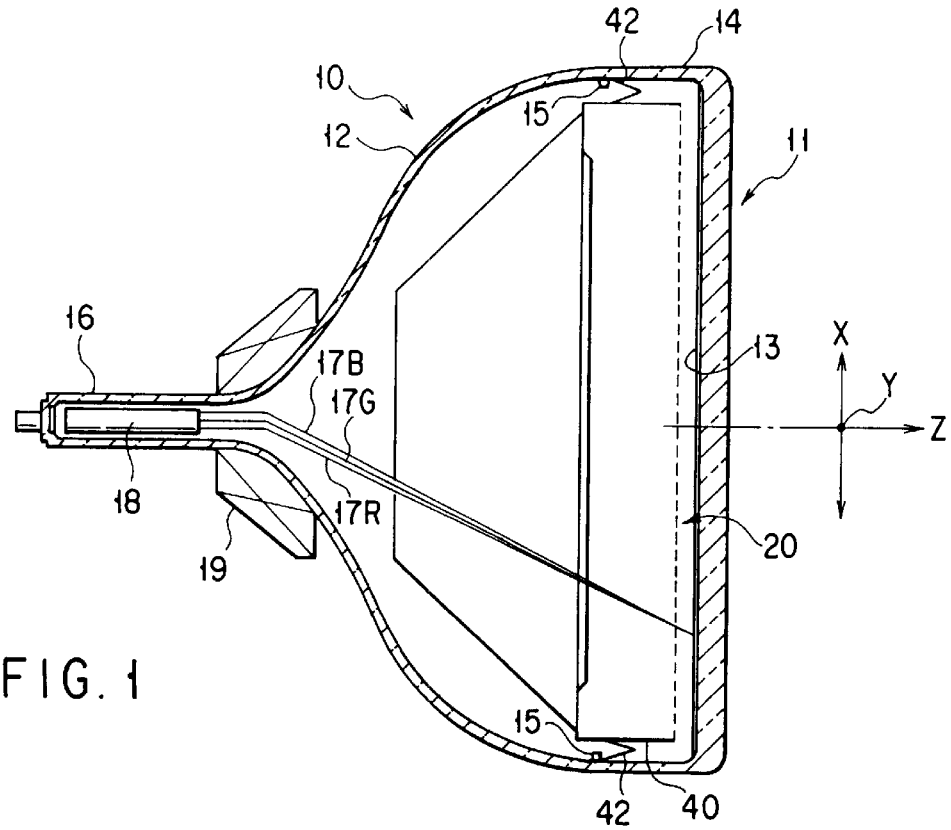
FIG. 1 is a horizontal sectional view schematically showing a configuration of a color cathode ray tube according to an embodiment of the present invention.

As shown in FIG. 1, the color cathode ray tube according to embodiments of the present invention is of a 32-inch wide type with a screen aspect ratio of 16:9 (effective diagonal dimension of screen: 76 cm) that is used in a TV set or the like. The outer surface of the panel of the tube has a curvature such that it is nearly perfectly flat.

This color cathode ray tube, which has a horizontal axis (X-axis) as a major axis and a vertical axis (Y-axis) as a minor axis, comprises an envelope 10 that is composed of a rectangular panel 11, having long sides that extend in the direction of the X-axis and short sides that extend in the direction of the Y-axis, and a funnel 12 connected to an end portion of the panel 11. A phosphor screen 13 is provided on a rectangular effective region of the inner surface of the panel 11. The screen 13 includes a large number of stripe-shape (or dot-like) three-color phosphor layers that glow red (R), green (G), and blue (B), individually, and black stripe-shaped light absorbing layers that are arranged individually in gaps between the phosphor layers.

A shadow mask 20 for use as a color sorting mechanism is located at a given space in the direction of a tube axis (Z-axis) from the phosphor screen 13 in the panel 11. The mask 20 is supported inside the panel 11 in a manner such that a plurality of elastic supporters 42 on the outer wall of a mask frame 40 (mentioned later) individually engage a plurality of stud pins 15 that are embedded in a sidewall 14 of the panel 11.

Further, an in-line electron gun assembly 18 is located in a cylindrical neck portion 16 of the funnel 12. The assembly 18 emits three electron beams 17B, 17G and 17R that are arranged on the horizontal axis (X-axis). Since the three electron beams 17B, 17G and 17R that are emitted from the electron gun assembly 18 are incident at different angles upon electron beam holes of the shadow mask 20, they land individually on the target phosphor layers, thereby causing the layers to glow in the given colors.

A deflection yoke 19 is located around a region near the joint of the neck portion 16 of the funnel 12. The yoke 19 generates a non-uniform deflecting magnetic field that deflects the electron beams 17B, 17B and 17R from the electron gun assembly 18 in the directions of the horizontal and vertical axes. This non-uniform deflecting magnetic field is formed of a horizontal deflecting magnetic field of a pincushion type and a vertical deflecting magnetic field of a barrel type.

The three electron beams 17B, 17G and 17R that are emitted from the electron gun assembly 18 self-converge toward the phosphor screen 13 as they are focused on their corresponding phosphor layers on the screen 13. Further, the three electron beams 17B, 17G and 17R are deflected by means of the non-uniform deflecting magnetic field and used to scan the phosphor screen 13 on the inner surface of the panel 11 in the directions of the horizontal and vertical axes. Thereupon, a color image is displayed.

Figure 2:
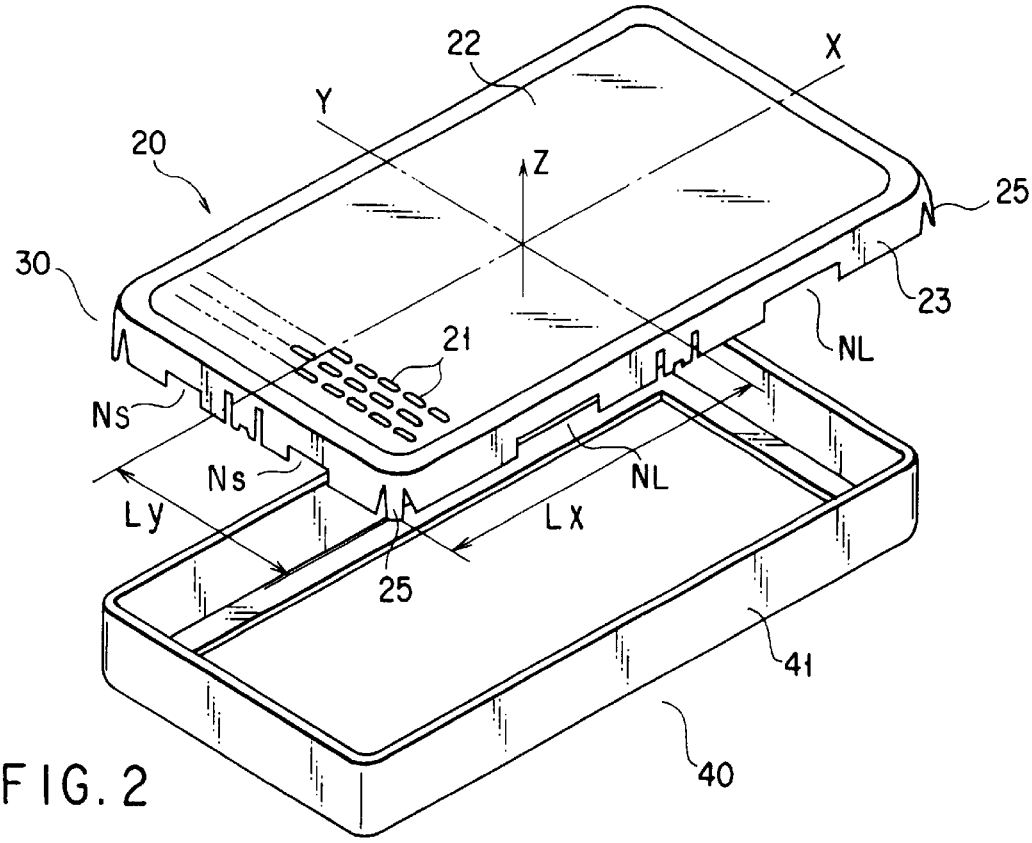
FIG. 2 is an exploded perspective view schematically showing the construction of a shadow mask assembly applied to the color cathode ray tube shown in FIG. 1.
Figure 3:
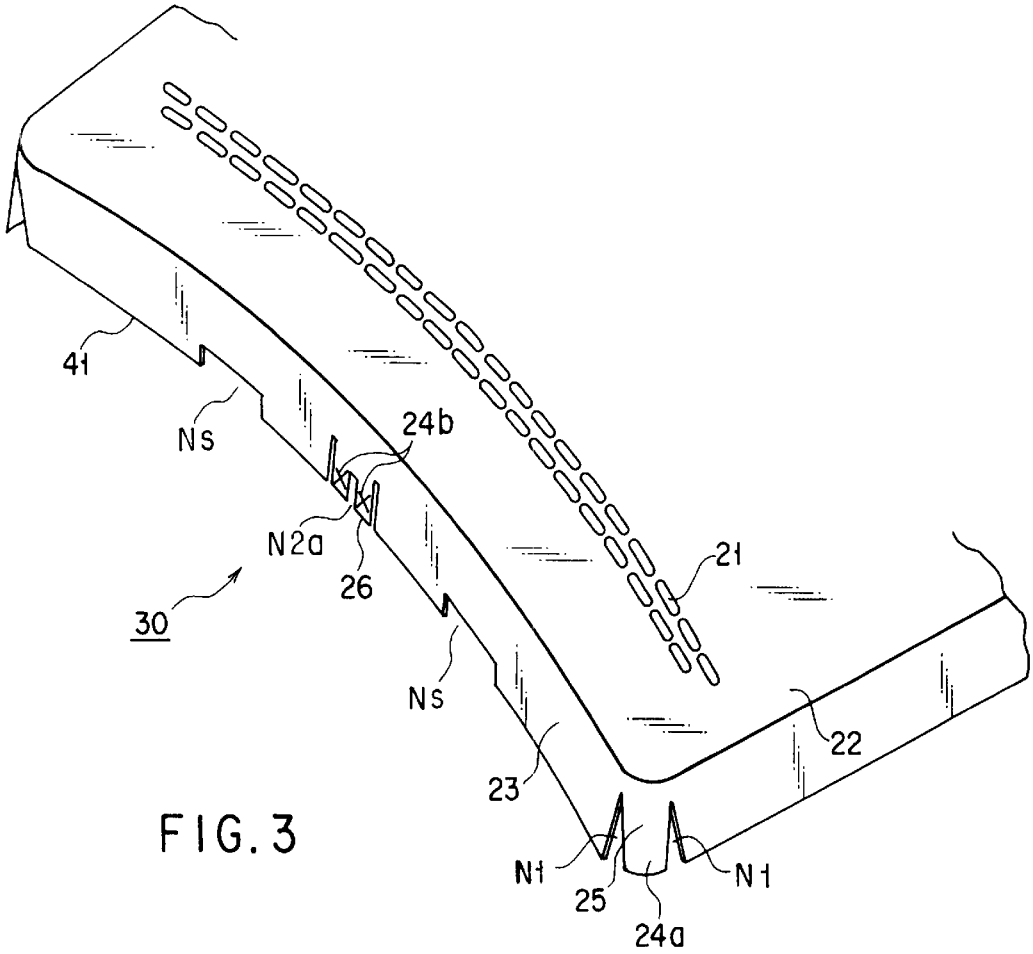
FIG. 3 is an enlarged perspective view showing a region near a short side portion of a mask body of the shadow mask assembly shown in FIG. 2.
Figure 4:
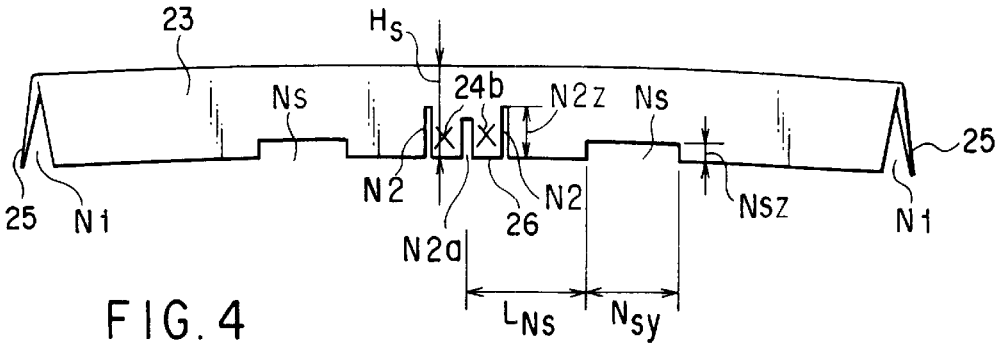
FIG. 4 is a side view showing the short side portion of the mask body of the shadow mask assembly shown in FIG. 2.
Figure 5:
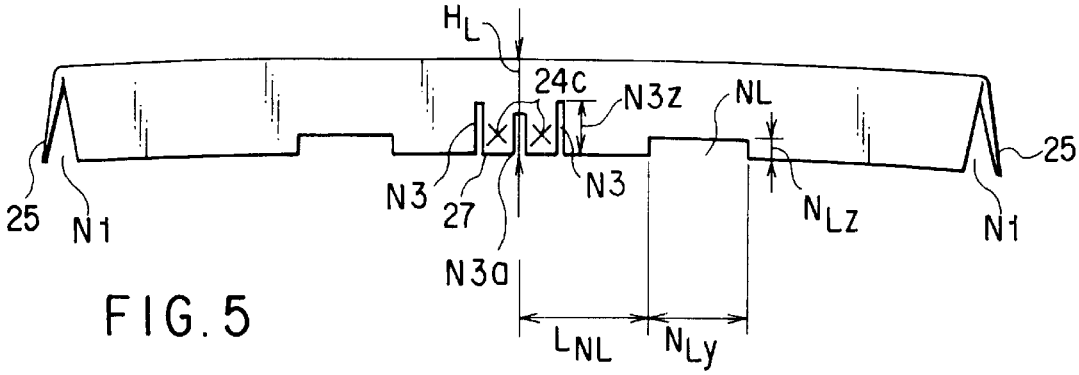
FIG. 5 is a side view showing a long side portion of the mask body of the shadow mask assembly shown in FIG. 2.

FIG. 2 shows the shadow mask 20 in a disassembled state, and FIGS. 3 to 5 show a structure near a skirt portion of a mask body of the shadow mask. The shadow mask 20 is composed of a mask body 30 and the mask frame 40.

The mask body 30 includes a rectangular effective portion 22, which has a large number of electron beam holes 21 arranged at given pitches in the directions of the horizontal axis (X-axis) and the vertical axis (Y-axis), and a skirt portion 23 that is bent from the periphery of the effective portion 22 and extends in the direction of the tube axis (Z-axis). The mask body 30 is formed by press-forming a metal sheet of a low-expansion material, such as invar (alloy of 36%-Ni and Fe, coefficient of thermal expansion: $1.2\times 10^{-6}/°$ C.), into a given shape. The mask frame 40 is a rectangular frame having an L-shaped cross section and fixedly supports the mask body 30. The mask frame 40 is formed of a material having a coefficient of thermal expansion higher than that of the material of the mask body 30, e.g., a low-carbon steel sheet (coefficient of thermal expansion: $12\times 10^{-6}/°$ C.).

The effective portion 22 of the mask body 30 is formed in the shape of a predetermined curved surface, and has long sides extending in the direction of the horizontal axis (X-axis) and short sides extending in the direction of the vertical axis (Y-axis). The skirt portion 23 is fixedly welded to the inside of a sidewall 41 of the rectangular mask frame 40 at a plurality of spots 24*a*, 24*b*, 24*c* (indicated by × in FIGS. 3 to 5). In this embodiment, the skirt portion 23 of the mask body 30 is fixed to the mask frame 40 in a manner such that it is subjected to some compressive stress toward the center (tube axis side), and the bulging strength of the curved surface is enhanced by means of the compressive stress. A technique for enhancing the bulging strength with the skirt portion 23 stressed is described in Jpn. Pat. No. 2703881 (corresponding to U.S. Pat. No. 4,739,216).

The elastic supporters 42 shown in FIG. 1 are provided outside the mask frame 40, and the shadow mask 20 is located in the panel 11 in a manner such that openings in the supporters 42 individually engage the stud pins 15 on the inner surface of the panel 11.

The skirt portion 23 of the mask body 30 extends in the direction of the tube axis (Z-axis) from the bent portion around the effective portion 22, and its end portion is open. The tube-axis-direction length of the portions of the skirt portion 23 other than those portions in which notches (mentioned later) are formed is adjusted to about 25 mm.

A pair of relatively long slit-shaped notches N1 are formed near each corner (point of intersection of long and short sides) of the skirt portion 23. The notches N1 define a tongue portion 25 for corner welding between them. Further, a pair of slit-shaped notches N2 are formed extending from the open end, near the end portion of a major-axis (X-axis) or near the center of each short side of the skirt portion 23. The notches N2 define a tongue portion 26 for side welding between them. Furthermore, a pair of slit-shaped notches N3 are formed extending from the open end, near the end portion of a minor-axis (Y-axis) or near the center of each long side of the skirt portion 23. The notches N3 define a tongue portion 27 for side welding between them. In this embodiment, slit-shaped notches N2*a* and N3*a* are additionally formed in the center of the welding tongue portions 26 and 27, respectively.

A rectangular cut portion NS having its longitudinal direction in the short-side direction is formed in that part of the skirt portion 23 which is situated between the tongue portion 26 for side welding and each tongue portion 25 for corner welding. Thus, the cut portion NS is located between each notch N1 for each tongue portion 25 for corner welding and its corresponding notch N2 for the tongue portion 26 for side welding.

Further, a rectangular cut portion NL having its longitudinal direction in the long-side direction is formed in that part of the skirt portion 23 which is situated between the tongue portion 27 for side welding and each tongue portion 25 for corner welding. Thus, the cut portion NL is located between each notch N1 for each tongue portion 25 for corner welding and its corresponding notch N3 for the tongue portion 27 for side welding.

The respective lengths of the cut portions NS and NL along the tube axis are shorter than that of the skirt portion 23.

The portions of the skirt portion 23 other than the welding tongue portions 25, 26 and 27 are kept in contact with the inside of the sidewall 41 or inner wall of the mask frame 40 in given positions.

In this embodiment, the skirt portion 23 has the following dimensions:

length (about half the short side length) Ly from the major-axis end portion to the diagonal end portion: 183.1 mm, length (about half the long side length) Lx from the minor-axis end portion to the diagonal end portion: 325.5 mm, tube-axis-direction lengths HS and HL of the skirt portion in a welding position: 25.0 mm, length N2*z* of each slit-shaped notch near the center of each short side: 13.5 mm, length N3*z* of each slit-shaped notch near the center of each long side: 13.5 mm, tube-axis-direction length NSz of each rectangular cut portion on each short side: 6.0 mm, longitudinal-direction length NSy of each rectangular cut portion on each short side: 40.0 mm, distance $L_{NS}$ from the major-axis end on each short side to the major-axis side end portion of each rectangular cut portion: 60.0 mm, tube-axis-direction length NLz of each rectangular cut portion on each long side: 6.0 mm, longitudinal-direction length NLy of each rectangular cut portion on each long side: 60.0 mm, distance $L_{NL}$ from the minor-axis end on each long side to the minor-axis side end portion of each rectangular cut portion: 60.0 mm.

On each short side of the skirt portion 23, based on these dimensional relationships, the length of the skirt portion 23 along the tube axis is shorter than the length of the other portions in a range where the rectangular cut portions NS are formed, that is, in a range corresponding to 33% to 55% of the distance from the major-axis (X-axis) end to the diagonal end. The tube-axis-direction length of the skirt portion 23 that is reduced by the presence of the rectangular cut portions NS is 19.0 mm, so that the remaining height is equal to 76% of the overall length (100%) of the skirt portion 23 along the tube axis.

On each long side of the skirt portion 23, on the other hand, the length of the skirt portion 23 along the tube axis is shorter than the length of the other portions in a range where the rectangular cut portions NL are formed, that is, in a range corresponding to 18% to 37% of the distance from the minor-axis (Y-axis) end to the diagonal end. The tube-axis-direction length of the skirt portion 23 that is reduced by the presence of the rectangular cut portions NL is 19.0 mm, so that the remaining height is equal to 76% of the overall length of the skirt portion 23 along the tube axis.

According to the color cathode ray tube constructed in this manner, the skirt portion 23 is provided with the cut portions NS and NL. If the other portions than the welding tongue portions are caused to spread out by a spring-back phenomenon after the mask body 30 is press-formed, therefore, accordingly, stress on the skirt portion 23 can be lessened, so that there is no possibility of the welding tongue portions being unduly pushed back inward. When the spread open end is brought into contact with the inner wall of the frame 40. Thus, deformation of the welding tongue portions and shifting of the welding positions can be prevented.

The inventors hereof variously examined the place for the formation of the rectangular cut portions, and found that the following ranges and shapes are preferable. Thus, the present invention is not limited to the dimensions according to the embodiment described above, and the dimensions may be suitably set within the following ranges.

If the distance from the major- or minor-axis end portion to the diagonal end is L, it is to be desired that each rectangular cut portion should be formed in a range from a position corresponding to 0.10×L to a position corresponding to 0.70×L, starting at the major- or minor-axis end portion. The range from the starting position corresponding to 0×L to the position corresponding to 0.10×L is close to each tongue portion for side welding, while the range from the position corresponding to 0.70×L to a position corresponding to 1.0×L is close to each tongue portion for corner welding. Under the influence of the slit-shaped notches, therefore, the spread caused by the spring-back phenomenon is originally restricted to a low extent. Since the spread that is attributable to the spring-back phenomenon is wide in the range between the slit-shaped notches, especially in the range from the position corresponding to 0.10×L to the position corresponding to 0.70×L, so that it is practical to locate each rectangular cut portion in a given position within this range. Preferably, each rectangular cut portion should be located in a range from a position corresponding to 0.20×L to a position corresponding to 0.60×L.

Since the open end portion of the skirt portion is rectangularly cut in this manner, its spread can be restrained if it is spread by the spring-back phenomenon to the same angle as in the case where there are no cut portions. As the spread is thus restrained, the welding tongue portions can be prevented from being displaced or deformed toward the mask center by the stress on the skirt portion that is directed to the mask center. Preferably, therefore, the effective tube-axis-direction length of each rectangular cut portion should be adjusted to 5% to 40% of the height (tube-axis-direction length) of the skirt portion. In other words, the height of the remaining portion of the skirt portion that is reduced by the presence of the cut portions should be adjusted to 60% to 95% of the height of the skirt portion in the welding positions. The aforesaid effect cannot be obtained if the tube-axis-direction length of each cut portion is too short. If the tube-axis-direction length of each cut portion is too long, on the other hand, the strength of the mask body is so low that the mask body cannot enjoy desired rigidity. Preferably, the height of the remaining portion of the skirt portion should be adjusted within the range of 70% to 85%.

Preferably, moreover, the width of each cut portion on each short or long side of the skirt portion 23 in the direction of the minor or major axis should be adjusted to 0.1×L to 0.45×L. The aforesaid effect cannot be obtained if the width of each cut portion in the longitudinal direction is shorter than 0.1×L. If the width is longer than 0.45×L, howling or the like occurs, so that the properties of the mask inevitably worsen.

Although two horizontally elongated rectangular cut portions are formed on each side according to the foregoing embodiment, the present invention is not limited to this embodiment. For example, four or more rectangular cut portions may be formed on each side, or cut portions may be formed on the short or long sides only.

Figure 6:
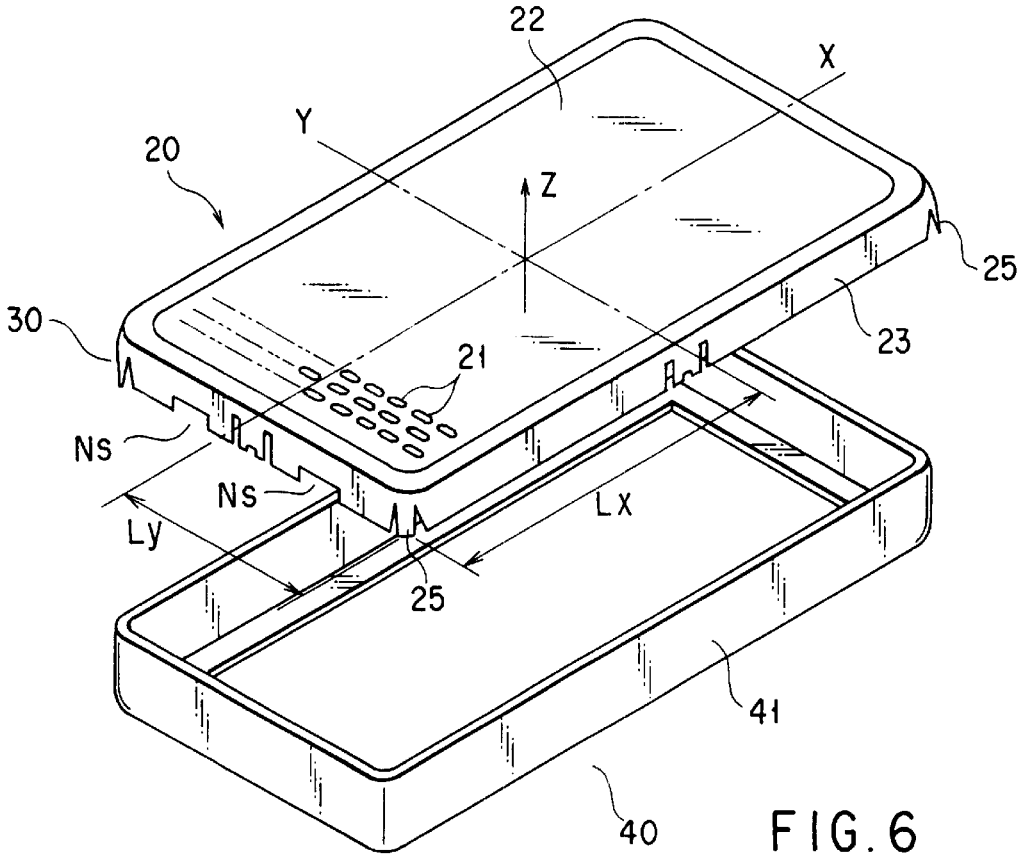
FIG. 6 is an exploded perspective view schematically showing the construction of a shadow mask assembly according to another embodiment of the invention.

FIG. 6 shows an example in which rectangular cut portions are formed on each short side only. The example shown in FIG. 6 is based on the same dimensional relationships with the example shown in FIG. 2 except for the absence of rectangular cut portions on the long sides. The same effect of the foregoing embodiment can be obtained with use of this arrangement.

Further, each cut portion need not always be rectangular, and may alternatively be semicircular or semielliptic, for example.

According to embodiments of the present invention, as described herein, there may be provided a color cathode ray tube in which the mask body and the mask frame can be prevented from being deformed or dislocated as they are fixed to each other.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

an envelope including a rectangular panel having a major axis and a minor axis perpendicular to each other;

a phosphor screen located on the inner surface of the panel;

an electron gun assembly which emits electron beams toward the phosphor screen; and a color sorting mechanism opposed to the phosphor screen, the color sorting mechanism including a mask body, having a rectangular effective portion with a large number of electron beam holes and a skirt portion bent from the periphery of the effective portion and extending along a tube axis perpendicular to the major and minor axes, and a mask frame having an inner wall fixedly fitted with the skirt portion of the mask body, the skirt portion including cut portions, the width of the cut portions along the minor or major axis ranging from 0.10×L to 0.45×L, where L is the distance from an end of the minor or major axis to a diagonal end, and the height of the cut portions along the tube axis being equal to 5% to 40% of the height of the skirt portion along the tube axis in a region near the minor or major axis.

2. A color cathode ray tube according to claim 1, wherein said cut portions are formed in a range from a position corresponding to 0.10×L to a position corresponding to 0.70×L, starting at the minor- or major-axis end portion.

3. A color cathode ray tube according to claim 1, wherein said cut portions are rectangular and are located on short sides parallel to the minor axis of the skirt portion.

4. A color cathode ray tube according to claim 1, wherein said cut portions are rectangular and are located on long sides parallel to the major axis of the skirt portion.

5. A color cathode ray tube according to claim 1, wherein said cut portions are rectangular and are located on each of short sides parallel to the minor axis of the skirt portion and each of long sides parallel to the major axis.

6. A color cathode ray tube according to claim 5, wherein said skirt portion includes tongue portions fixed to the mask frame, at the major-axis end portions on the short sides, the minor-axis end portions on the long sides, and the points of intersection of the short and long sides, each of the tongue portions being formed in a region between a pair of slit-shaped notches.

7. A color cathode ray tube according to claim 6, wherein said cut portions are located between notches on the points of intersection and notches on the short sides and between the notches on the points of intersection and notches on the long sides.

8. A color cathode ray tube according to claim 1, wherein the outer surface of said panel has a curvature such that the outer surface is substantially flat.

9. A color cathode ray tube according to claim 1, wherein said mask frame is formed of a material having a coefficient of thermal expansion higher than that of the material of the mask body.

10. A color cathode ray tube according to claim 9, wherein said mask body is formed of an alloy consisting mainly of iron and containing 36% of nickel.

* * * * *